United States Patent [19]

Peltier

[11] Patent Number: 4,840,061

[45] Date of Patent: Jun. 20, 1989

[54] METHOD OF DETECTING A FLUID INFLUX WHICH COULD LEAD TO A BLOW-OUT DURING THE DRILLING OF A BOREHOLE

[75] Inventor: Bertrand Peltier, Cambridge, Great Britain

[73] Assignee: Schlumberger Technology Corporation, Houston, Tex.

[21] Appl. No.: 216,579

[22] Filed: Jul. 8, 1988

[30] Foreign Application Priority Data

Jul. 15, 1987 [FR] France ..... 87 09963

[51] Int. Cl.[4] ..... E21B 47/00

[52] U.S. Cl. ..... 73/155; 73/3

[58] Field of Search ..... 73/155, 3; 364/422; 340/606, 610

[56] References Cited

U.S. PATENT DOCUMENTS

| | | | |
|---|---|---|---|
| 3,726,136 | 4/1973 | McKean et al. | 73/155 |
| 3,740,739 | 6/1973 | Griffin, III et al. | 340/239 R |
| 3,750,766 | 8/1973 | Thompson et al. | 175/50 |
| 3,982,432 | 9/1976 | Hammond | 73/151.5 |
| 4,188,624 | 2/1980 | Hochsprung et al. | 340/606 |
| 4,253,530 | 3/1981 | Sharki et al. | 175/25 |
| 4,527,425 | 7/1985 | Stockton | 73/155 |
| 4,565,086 | 1/1986 | Orr, Jr. | 73/23 |

FOREIGN PATENT DOCUMENTS 292328 8/1971 Austria .

OTHER PUBLICATIONS

World Oil, vol. 199, No. 7, Dec. 1984, pp. 75, 76, 78, 80, 82, Gulf Publication Co., Houston, TX, U.S.; A. T. Bourgoyne, Jr., "Bubble Chopping: A New Way to Control Large, Deep Gas Kicks".

*Primary Examiner*—Jerry W. Myracle

*Attorney, Agent, or Firm*—Stephen L. Borst

[57] ABSTRACT

This invention is intended for use in the process of drilling an oil well and has to do with a process for the detection of fluid influx which could lead to a blow-out. This process consists of measuring the inlet flow rate A of the drilling mud coming into the well and the outlet flow rate B of the drilling mud rising from the well in order to arrive at the quantity:

$$C = a.B - A$$

where a is a scale factor the value of which can be altered so as to bring about a recalibration of the outlet rate measurement. Such recalibration is made each time the average value of C, in relation to a given period of time, reveals a significant difference between the rates, and an alarm is set off in accordance with the frequency of the recalibrations corresponding to an excess in the outlet rate in relation to the inlet rate.

7 Claims, 3 Drawing Sheets

METHOD OF DETECTING A FLUID INFLUX WHICH COULD LEAD TO A BLOW-OUT DURING THE DRILLING OF A BOREHOLE

BACKGROUND OF THE INVENTION

This invention is intended for use in the process of drilling a borehole e.g. an oil well, and has to do with a process for fluid detection which could lead to a blow-out. Detection of this event is based on the difference between the inlet and outlet flow rates of the drilling mud injected into the borehole.

When, during the drilling of a borehole, one has passed through an impermeable layer and then reaches a permeable layer containing a liquid or gaseous fluid under pressure, this fluid tends to push its way into the borehole if the column of drilling mud in the hole is unable to counter- balance the pressure of the formation fluid. The latter fluid then pushes the mud upwards: there is then said to be a fluid influx. This produces an unstable condition: as the fluid replaces the mud in the borehole, the average density of the counter-pressure column inside the hole decreases and the imbalance is aggravated. If no steps are taken to correct this, the condition accelerates and leads to a catastrophic blow-out.

It is therefore of the greatest importance that one be able to detect the onset of this condition as early as possible, i.e. when the influx is still at the controllable stage when one can take immediate emergency action which consists of closing the well at the surface using a blow-out preventer.

This detection can be achieved by measuring the inlet flow rate of the mud injected into the shaft, the outlet flow rate of the mud rising from the well and calculating the difference between these two flow rates. When the difference is no longer zero in that the outlet rate exceeds the inlet rate, this marks the onset of instability in the well.

Measuring the inlet flow rate presents no difficulty: one can use a flowmeter, of the magnetic type for instance, or one can calculate the rate from the speed of the pump which causes the mud to circulate, e.g. of the volumetric type. It is more difficult to calculate the outlet rate, however: this measurement actually has to make allowance for the fact that the mud, when it comes out of the well, is soiled and takes the form of a heterogeneous mixture (water, oil, fines, cuttings) of a thixotropic consistency. It is not possible to measure the flow rate of such a mixture to any degree of accuracy using a conventional flowmeter.

The purpose of this invention is to provide early, automatic and reliable detection, at low cost, of fluid influx in wells, by analyzing the difference between the inlet and outlet flow rates of the drilling mud, despite the imprecision involved in the measurement of the outlet flow rate.

SUMMARY OF THE INVENTION

This is achieved by means of a new method which consists basically of measuring the inlet rate A of the drilling mud in the well and the outlet rate B of the drilling mud rising from the well, giving the quantity:

$$c = a.B - A$$

where a is a scale factor, the value of which may be altered in order to bring about a recalibration of the outlet flow rate measurement. Such recalibration is made each time the average value of the quantity C, in relation to a given period of time, reveals a significant difference between the inlet and outlet flow rates, An alarm is set off in accordance with a predetermined criterion on the basis of the frequency of the recalibrations which correspond to an excess in the outlet flow rate in relation to the inlet flow rate.

This method ensures the desired detection of the influx by taking advantage of the unstable nature of the condition under consideration, in that the instability makes itself apparent in the form of a continuous, growing variation in the outlet rate in relation to the inlet rate. Thanks to the repeated recalibration process employed as far as the outlet rate is concerned, the measurement of the latter rate can be carried out, without the problem of imprecision, using a simple "rate indicator", such as a paddle flow indicator. It is only necessary that this indicator offers a certain degree of linearity. The process therefore makes it possible to detect persistent instability in the well based on variations in the outlet rate, despite not having any clear knowledge of the absolute value of that flow rate.

Preferably an alarm will be set off when, over a fixed period of time, a certain number of consecutive recalibrations takes place, each corresponding to an increase in the average value of quantity C.

Under the favorable conditions of operation provided, one determines the average value of quantity C by calculating the quantity:

$$D = C\,dt$$

on the basis of the preceding recalibration. One then compares this quantity D using a positive threshold $p_1$ and a negative threshold $p_2$ and, when the value of quantity D reaches the positive threshold, one carries out a recalibration by altering the value of the calibration factor a in such a way that, at the (i−1)th recalibration, this calibration factor passes from $a_i - 1$ to:

$$a_i = a_{i-1} - C_m^{i-1} / B_m^{i-1},$$

$C_m^{i-1}$ and $B_m^{i-1}$ indicating the mean or average values of quantities C and B calculated with the help of the preceding value $a_{i-1}$ on the basis of the recalibration of i−1. A similar recalibration, but in the opposite direction, is carried out when the value of quantity D reaches the negative threshold $p_2$, whereas the value of that quantity is put back to zero at each recalibration. Thus, at the (i−1)th recalibration, the quantity C is put back to the value it would have assumed if $C_m^{i-1}$ had been zero.

It is appropriate to carry out the above mentioned calculations, aimed at determining the average value of quantity C and its divergence from zero, by means of Hinkley's algorithm which is designed for detecting variations in the average value of a quantity. However, other algorithms may also be used.

In practice, the positive threshold $p_1$ referred to above may be put at around 50 liters, and the frequency of recalibrations at which an alarm is set off may be fixed at 3 recalibrations in approximately 20 minutes. As regards the negative threshold $p_2$, this may be equal, in absolute terms, to the positive threshold $p_1$.

It is recommended that, when using/processing quantity C, which represents the relative difference in rates, any variations of an insignificant magnitude and of no real interest be ignored. For this purpose, the integration of quantity C is only employed with those values which are outside of an interval marked by positive and negative sensitivity thresholds, equal in absolute value (chosen, for example, at around 10 liters/min). In this way one sets up a margin beyond which differences in rate are not taken into account.

DESCRIPTION OF THE PREFERRED EMBODIMENT

Other characteristics and advantages of the invention will be born out more clearly in the following description which relates to the attached drawings; these are merely an example of how the above defined process might be applied.

Figure 1:
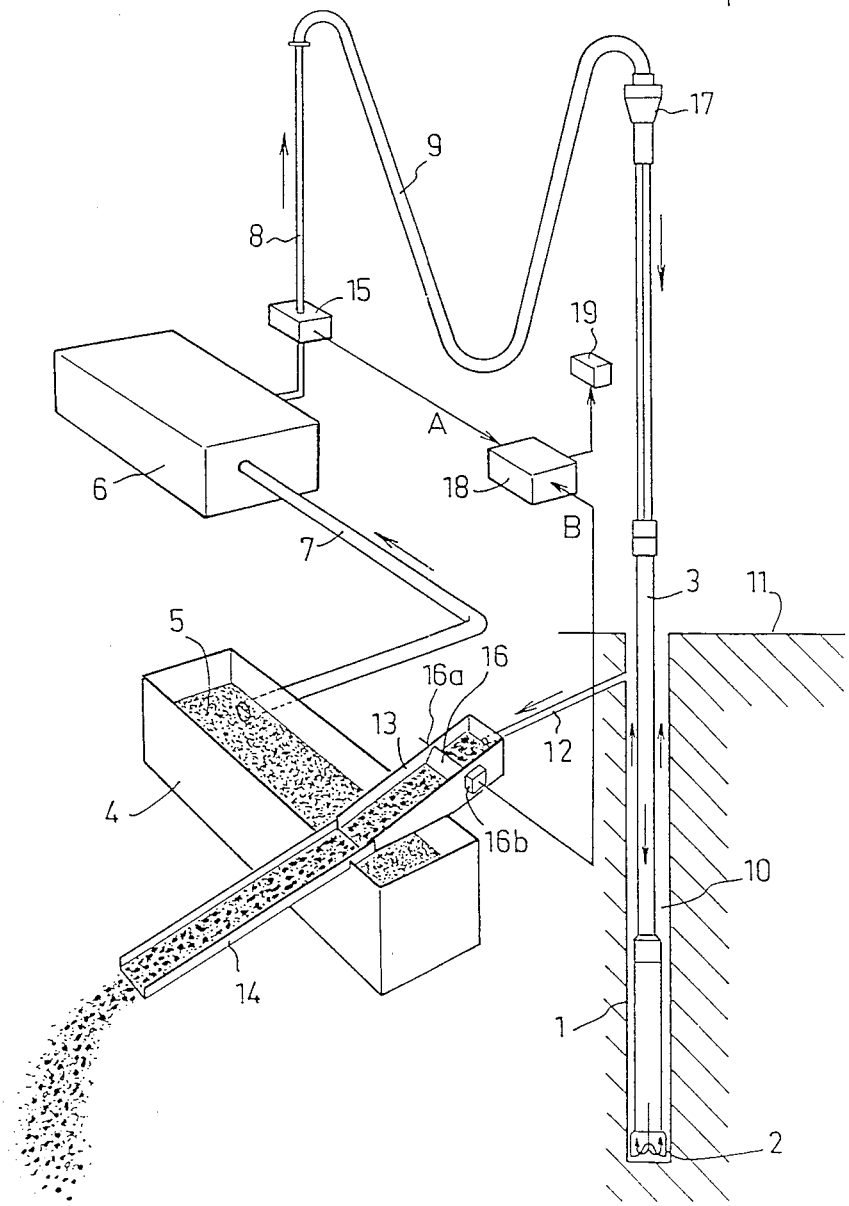

FIG. 1 represents, in diagram form, the drilling mud circuit in a well.

Figure 2:
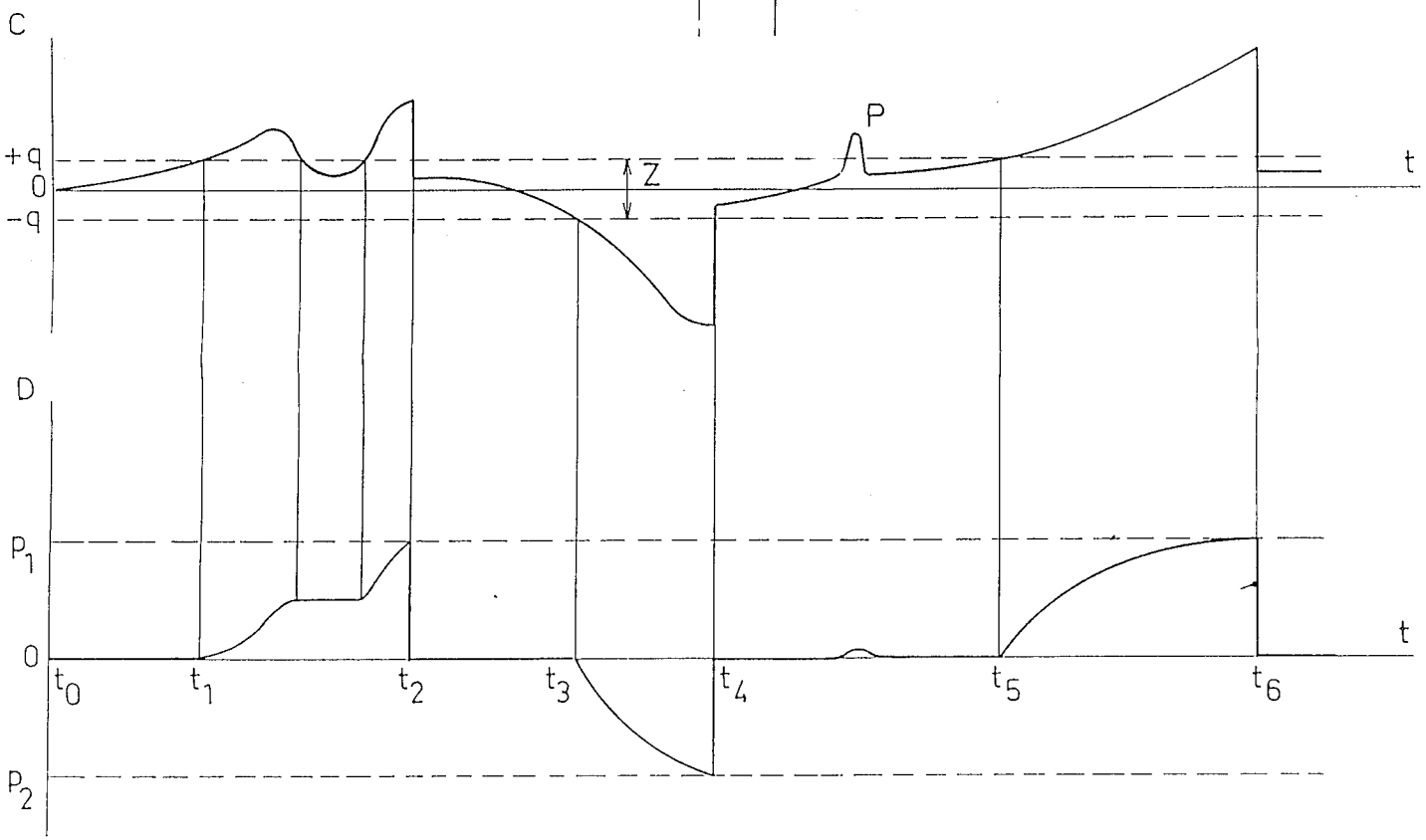

FIG. 2 gives an example of variations, over a period of time, in quantity C which represents the difference in drilling mud inlet and outlet flow rates in the well, and the corresponding integral D in relation to the time period involved.

Figure 3:
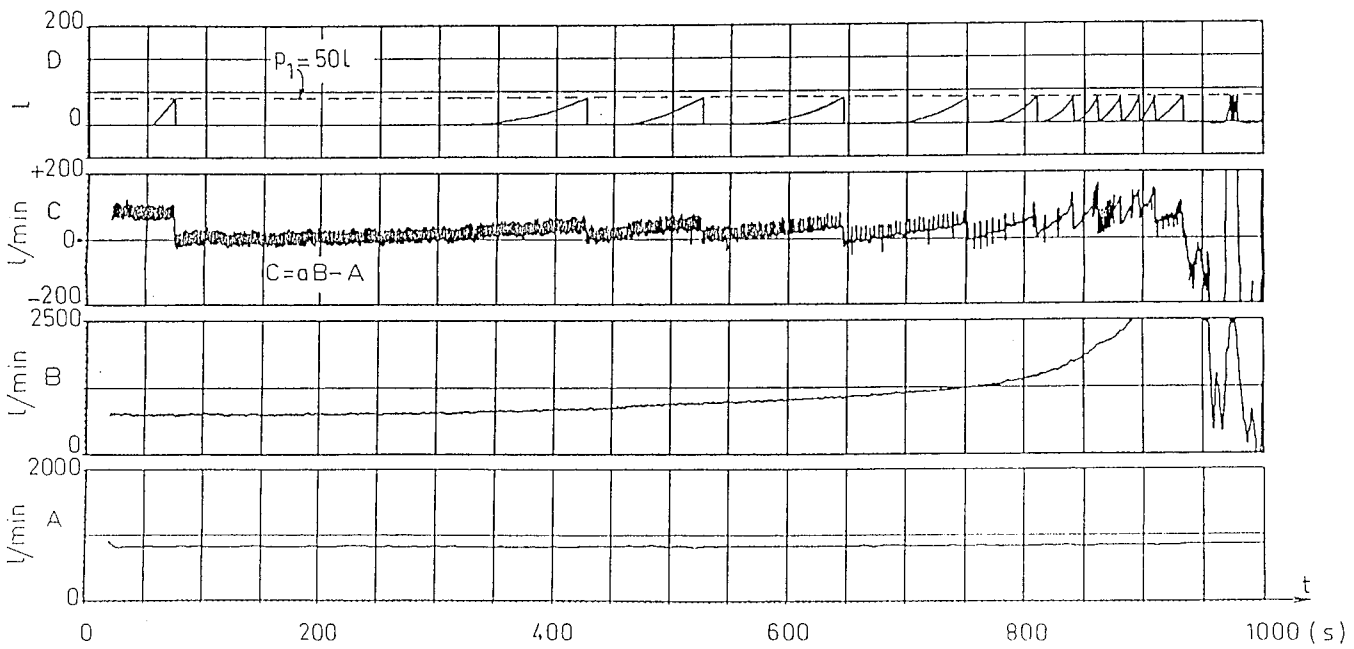

FIG. 3 gives an example of experimental readings in connection with curves representing the variations, as a function of time, in inlet flow rate A and outlet flow rate B, as well as quantities C and D referred to above.

In FIG. 1 we see the drilling mud circuit in a well (1) in the process of being drilled by means of a drill bit (2) attached to the end of a drill string (3). The drilling mud circuit consists of a pit (4) containing the drilling mud (5), a mud pump (6) which, via a pipe (7), draws the mud from the pit (4) and drives it into the well, via a rigid pipe (8) and a flexible pipe (9) connected to the drill string (3) via an injection head (17). The mud escapes from the drill string at the drill bit (2) and reascends the well via the annulus (10) formed between the drill string and the wall of the well. As it approaches ground level (11) the mud is directed through an outlet pipe (12), flowing with an open surface, towards an inclined channel (13) from where it is poured back into the pit (4), the solid particles and various fragments it may have picked up on the way being removed via a ramp (14).

The inlet flow rate A of the mud is measured by means of a flowmeter fitted in pipe (8). Since the mud coming from pit (4) has been purified and homogenized in the pit, it is possible to use a conventional flowmeter which gives measurements of acceptable accuracy.

This is not the case, however, at the outlet from the well where the mud is of an heterogeneous composition full of impurities. Because of its heterogeneous nature, use is made of a device able to handle the poor quality of the mud coming out of the well in order to determine the outlet flow rate. One example of the flow out measurement may take the form of a pivoting paddle flow indicator (16) whose rectangular shape corresponds to the section of the channel (13), and which is able to turn about an horizontal axis (**16*a*) which extends along its upper edge. Depending on the flow rate of the mud, the paddle (16) adopts a varying angle with the vertical which is measured by means of a rotating sensor (16*b*) (e.g. a potentiometer) fixed to axis (16*a***). This detector supplies signal B which is dependent on the outlet flow rate.

The signals A and B thus created, representing the inlet and outlet flow rates of the drilling mud, are fed into a processing instrument (18) where they are compared one with the other. To be more precise, signal A is subtracted from a signal aB obtained by multiplying signal B by a scale factor whose value may be altered, thus producing the difference signal:

$$C = a.B - A$$

When drilling begins, it may be assumed that the inlet and outlet flow rates are equal and that the value of C is zero (FIG. 2). If C remains at a low level, between two thresholds q q, it can be concluded that the flow rates are practically equal and that there is no reason to fear any influx in the well (1).

Where the value C decreases, as shown between $t_2$ and $t_4$ in FIG. 2, the outlet rate is decreasing and falling below the inlet rate. This indicates that there is a loss of drilling mud due to the fact that the rocks in which the shaft has been drilled are absorbing some of the mud injected. Here again there is no risk of danger of a blow-out.

If, on the other hand, value C increases, as for instance between $t_4$ and $t_6$, the outlet flow rate is increasing in comparison with the inlet rate indicating that fluids from the ground in which the well is being sunk entered the well itself. There is thus an increase in the volume of mud. If this condition were allowed to continue unchecked, there would be the risk of influx and perhaps of a blow-out at the surface.

In order to analyze the variations of signal C, one uses integration over time to give signal D. To be more precise, signal C is integrated only when it falls outside of the safety margin Z (FIG. 2) marked by the thresholds q q (for example q = 10 liter/min), so as to eliminate variations of C which are too small to be of any significance. Moreover, variations of short duration, due to noise, such as point P, are eliminated from the integration operation.

The range of signal D is bounded by two thresholds $p_1$ and $p_2$, having opposite signs but the same absolute value (for example, 50 liters). Whenever signal D reaches one of these thresholds, a recalibration of the signal with respect to outlet rate B is carried out by imposing a modification on the scale factor a , by which that rate if multiplied, in order that the value of quantity C is brought near to zero. In the example in FIG. 2, such recalibrations take place at points $t_2$ and $t_6$ (where positive threshold $p_1$ is passed) and point $t_4$ (where negative threshold $p_2$ is passed). Furthermore, at each recalibration signal D is brought back to zero.

When, in a given interval of time T (20 minutes), three consecutive recalibrations take place and all three have to do with an increase in value C (thus involving a crossing of positive threshold $p_1$ by integrated quantity D), this is taken as an indication of the risk of influx. A signal is then sent by instrument (18) to an alarm device (19) (FIG. 1), warning all personnel engaged in the drilling work.

It is possible to provide for an ascending order of alarm levels, indicating increasing level of concern, up to the maximum level which indicates the imminence of a blow-out.

The threshold values q, $p_1$ and $p_2$ are fixed at their respective levels, on the basis of the specific conditions encountered and on the desired degree of sensitivity required for detection.

In practice the treatment applied to signal C is based on Hinkley's algorithm which makes it possible to detect a given change in the average value of a variable quantity (in this case, the difference in flow rates represented by signal C).

The curves in FIG. 3 provide an example of this process in operation. The curves illustrated were recorded during experimentation on a test well.

Curve A is noticeably rectilinear and horizontal. It corresponds to a constant inlet rate equal to approximately 1,700 L/min. Curve B shows, on the basis of a value of around 1,800 L/min, an increase which becomes more and more pronounced. The scale factor a being assumed to have an initial value equal to one, curve $C=a.B-A$ starts out from a value equivalent to 100 L/min. This value, which is uncertain due to the imprecision of the outlet rate indicator, being judged as too high, a preliminary recalibration is carried out at point t=75s. The value of C then increases slowly and integrated signal D reaches threshold $p_1=+50$ liters at point t=425 s, at which time a first recalibration takes place. The same thing happens at points t=525 s and t=640 s. At the end of these last three recalibrations, corresponding to an increase in the outlet rate and occurring during a period of time less than 20 minutes, an alarm of the first level is set off. Then, as the outlet rate increases more and more quickly, the recalibrations come closer together and alarms at higher levels are set off. In order to avoid false alarms during periods when large variations in drilling mud flow may occur, possibly causing significant differences in rate between the inlet and the outlet flow rates, albeit of short duration, as a consequence of the natural delay presented by the outlet rate with respect to the inlet rate, it is advisable to take the precaution of suspending monitoring of the difference in rate (quantity C):

- for 60 seconds after detection of a variation in the inlet rate which is faster than a predetermined value;
- for 10 seconds after detection of a variation in the position of the drill string which is faster than a predetermined value, in order to take account of fluctuations in the volume occupied by the drill string in the well;
- when the inlet rate falls beneath 100 L/min, owing to the lack of reliability with respect to the responsiveness of the outlet rate indicator for small flow rates.

Each time monitoring of the difference of rate C is resumed, a recalibration is carried out.

I claim:

1. A method of detecting a fluid influx in a well being drilled, such as an oil well, said fluid influx possibly resulting in a blow-out, the detection being based on the difference between the inlet (A) and outlet (B) flowrates of the drilling mud injected into the well, said method comprising the steps of measuring the inlet rate A and the outlet rate B of the drilling mud and forming the quantity:

$$C=a.B-A$$

where a is a scale factor the value of which may be altered in order to produce a recalibration of the outlet flow rate measurement; effecting this recalibration whenever the average value of quantity C, in relation to the period of time involved, identifies a significant difference between the inlet and outlet flowrates; and setting off an alarm when, over a fixed period of time, a certain predetermined number of consecutive recalibrations corresponding to an outlet flowrate which exceeds the inlet flowrate takes place, each of them corresponding to an increase in the average value of quantity C.

2. The method according to claim 1, in which the average value of quantity C is arrived at by calculating the quantity:

$$D=C\,dt$$

on the basis of the preceding recalibration, followed by a comparison of this quantity D within the context of a positive threshold $p_1$ and a negative threshold $p_2$ and, when the value of quantity D reaches the positive threshold, a recalibration is carried out, modifying the value of factor a in such a way that, at the (i−1)th recalibration, this factor passes from $a_i-1$ to:

$$a_i=a_{i-1}-C_m i-1/B_m i-1,$$

$C_m i-^1$ and $B_m i-^1$ indicating the average values of quantities C and B calculated using the preceding value $a_{i-1}$ on the basis of the recalibration of i−1, a similar recalibration, albeit in the opposite direction, being carried out when the value of quantity D reaches the negative threshold $p_2$, whereas the value of that quantity is returned to zero with each recalibration.

3. The method according to claim 2, in which said average value of quantity C and its divergence from zero are determined on the basis of Hinkley's algorithm.

4. The method according to claim 2 in which said positive threshold $p_1$ is fixed at around 50 liters, and the frequency of recalibrations at which an alarm is triggered is put at 3 in approximately 20 minutes.

5. The method according to claim 2 in which said positive and negative thresholds $p_1$ and $p_2$ are equal in absolute values.

6. The method according to claim 2 in which said quantity C is only subject to integration in connection with values which fall outside of interval Z defined by the positive and negative sensitivity thresholds q,-q.

7. The method according to claim 6, in which the value of q is put at around 10 L/min.

* * * * *